United States Patent [19]

Chi Yu

[11] Patent Number: 4,593,738

[45] Date of Patent: Jun. 10, 1986

[54] VENETIAN BLIND

[76] Inventor: Simon S. Chi Yu, 4090 Whittle Ave., Oakland, Calif. 94602

[21] Appl. No.: 695,065

[22] Filed: Jan. 25, 1985

[51] Int. Cl.[4] ..... E06B 9/00

[52] U.S. Cl. ..... 160/176 R; 160/166 R; 160/167; 160/174; 160/236

[58] Field of Search ..... 160/176 R, 174, 166 R, 160/167, 236

[56] References Cited

U.S. PATENT DOCUMENTS

| | | | |
|---|---|---|---|
| 3,122,954 | 3/1964 | Nadosy | 160/166 R |
| 3,472,305 | 10/1969 | Lefer | 160/236 |
| 3,645,317 | 2/1972 | Malone | 160/236 |
| 3,918,513 | 11/1975 | Englund | 160/176 R |
| 4,257,470 | 3/1981 | Woodle | 160/176 R |
| 4,292,763 | 10/1981 | Barnes | 160/236 |
| 4,475,579 | 10/1984 | Bassett | 160/236 |

FOREIGN PATENT DOCUMENTS

| | | | |
|---|---|---|---|
| 566002 | 4/1958 | Belgium | 160/166 R |

*Primary Examiner*—Reinaldo P. Machado
*Attorney, Agent, or Firm*—Bielen & Peterson

[57] ABSTRACT

A venetian blind utilizing a first elongated slat which is suspended by a pair of lines connected to opposite end portions of the slat along the elongation dimension. A second slat is placed atop first slat and is connected to a third line which moves one end portion of the elongated second slat along the top of the first slat.

11 Claims, 6 Drawing Figures

VENETIAN BLIND

The present invention related to a novel venetian blind apparatus.

Venetian blinds of conventional construction include a number of horizontal slats that are set at any of several angles to vary the amount of light admitted to a window, door or opening in an edifice. For example reference is made to U.S. Pat. No. 3,918,513 which describes a type of venetian blind and includes a rod actuated worm gear tilting assembly.

The opacity characteristic of the individual slats of a conventional venetian blind may not be varied without substituting slats. This process is highly impracticle for the normal user of venetian blinds.

In addition, the venetian blind shown in the referenced U.S. Pat. No. 3,918,513 is susceptible to breakage when the actuating rod is twisted beyond the normal stop position.

A venetian blind apparatus which solves the problems above enumerated would be an advance in the venetian blind art.

SUMMARY OF THE INVENTION

In accordance with the present invention a novel venetian blind assembly is provided.

The venetian blind of the present invention utilizes a first elongated slat which has a top, bottom, and an edge portion. The first slat further includes first and second end portions which extend along the elongation dimension thereof.

First and second lines are linked to the first and second end portions of the first slat to suspend the same horizontally. The first and second lines may be moved manually or incorporated into a worm gear assembly normally used with conventional venetian blinds. Bridging lines may be employed along the top and bottom of the first elongated slat to form a ladder. Of course, multiple slats similar to the first elongated slat may be placed in paralled above and below the same to form a venetian blind.

The present venetian blind assembly also a second elongated slat having a top, bottom and an edge portion between. First and second portions are also provided on the second slat extending along the access of elongation of the same. The second slat is placed atop the first slat and is linked to a third line at one end thereof. The movement of the third line at an angle to the place of the second slat may be used to drag the second end portion of the second slat along the top of the first slat. Thus, the second slat is independently movable in relation to the first slat.

The second slat may be linked to the third line by means of a fourth line which connects to the third line and engages a tab formed in a slot through the second slat. The tab may have diverging edge portions to cinch the fourth line and hold the same tightly. Moreover, the second slat may be constructed with different opacity characteristics then those of the first slat.

The venetian blind assembly also is deemed to include a device for controlling a twisting force on an object. The device employs a plate having first and second sides and an opening through the same. The edge of the opening through the plate includes at least one protuberance and may be angulated i.e. formed into a square, hexagon, or the like.

A member having first and second resilient legs extends through the opening in the plate and fits therewithin. The legs of the member are rotatable within in the plate if sufficient twisting force is applied to the member. The protuberance within the opening in the plate would force the first and second legs toward one another during this rotational motion. The member extends from the first side of the plate and connects to the object which is to be twisted. Thus, turning of the plate will turn the object until resistance to twisting the object occurs. At this point the member will slip within the opening through the plate preventing further twisting of the object.

The member extending from the first side of the plate includes a flange which may be substantially covered by a cap. Consequently, the member is held in place between the first side of the plate and the cap. Further, the member may extend through the cap for connection to the object which is to be twisted. The cap may be expandable for the purposes of assembly.

It may be apparent that a novel and useful venetian blind has been described. It is therefore an object of the present invention to provide a venetian blind which includes a dual slat mechanism where each of the slats includes a different opacity characteristic and where each of the slats is independently operable.

It is another object of the present invention to provide a ventian blind which is capable of completely blocking light from entering a space through an opening or which is capable of wholly or partially transmitting light through the individual slats of the blind.

A further object of the present invention is to provide a venetian blind which is capable of reducing heat loss through an opening in an edifice.

Another object of the present invention is to provide a venetian blind which includes a hand operated control rod which may be used with a worm gear for operating the venetian blind having a slip mechanism to prevent damage to the worm gear.

The invention possesses other objects and advantages especially as concerns particular characteristics and features which will become apparent as the specification continues.

Figure 1:
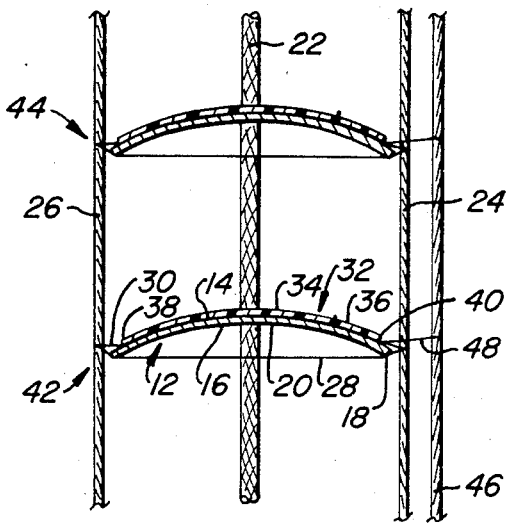
FIG. 1 is a sectional view of venetian blind of the present invention with both slats in an open position.

For a better understanding of the invention reference is made to the hereinafter described description of the preferred embodiments thereof which should be referenced to the hereinabove drawings.

DESCRIPTION OF THE PREFERRED EMBODIMENTS

The venetian blind described in FIGS. 1–4 of the present invention is designated by reference character 10 in its entirety. A venetian blind 10 includes as one of its elements a first slat 12, FIGS. 1–3. First slat 12 includes a top 14, bottom 16, and edge portion 18 therebetween. First slat 12 may be of conventional construction and includes an opening through the center 20 for guideline or liftcord 22. Slat 12 may be constructed of known materials such as aluminum, wood, and the like. First and second lines 24 and 26 tilt slat 12 in the known manner. Bridging lines 28 and 30 extend beneath bottom 16 and above top 14 of slat 12 to control the tilting of first slat 12 by lines 24 and 26. It should be noted, lines 24 and 26 may be included in a worm gear mechanism known in the art.

Figure 2:
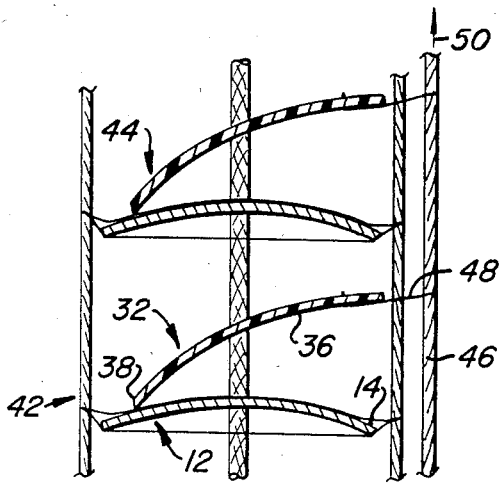
FIG. 2 is a sectional view of venetian blind of the present invention showing one of the slats in a partially closed position.
Figure 3:
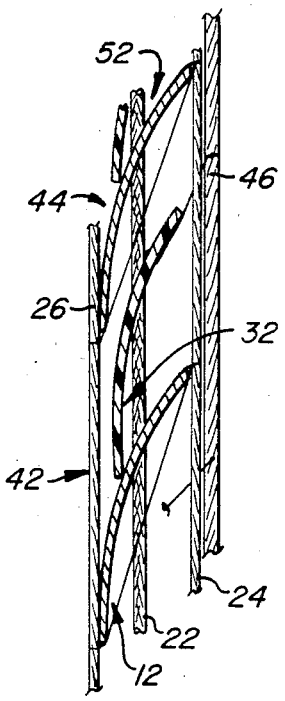
FIG. 3 is a sectional view of the venetian blind of the present invention showing both slats of the mechanism in a closed position.

A second elongated slat 32 is also depicted in FIGS. 1 through 4. Second slat 32 possesses the same general shape as first slat 12 but may be constructed of material having a different opacity than first slat 12. Second slat 32 includes a top 34, bottom 36 and end portions 38 and 40. First and second slats 12 and 32 form a slat unit 42 as shown in FIGS. 1–3. Other slat units such as slat unit 44 may be provided. Line 46 is linked to end portion 40 of second slat 32 by the way of line 48 which is formed into a loop, best shown in FIG. 4. Second slat 32 rests on top of first slat 12, but may be tilted individually by the movement of line 46 as shown in FIGS. 1–3. With reference to FIG. 2 it may be seen that line 46 has been pulled upwardly, according to directional arrow 50, such that the end portion 38 of second slat 32 moves along the top 14 of first slat 12. Movement of line 46 downwardly, opposite to the movement shown by directional arrow 50, would again result in the configuration shown in FIG. 1. It should be noted that other slat units such as slat unit 44 include similar slats to first slat 12 and second slat 32 in the support structures hereinabove described.

Turning to FIG. 3 it may be seen that lines 24 and 26 have been moved in opposite directions to tilt first slat 12 and line 46 has tilted second slat 32 to its extreme position. It should be observed that second slat 32 fits beneath the conventional slat 52 of slat unit 44 to form a barrier for the movement of and convection heat through venetian blind 10.

Figure 4:
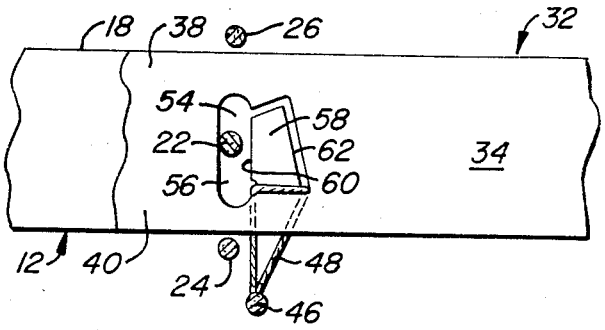
FIG. 4 is a top plan view of the second slat of the venetian blind of the present invention showing the slot tab used for connecting a line.

With specific reference to FIG. 4, a slot 54 is included which passes through second slat 36. Slot 54 includes an oval opening 56 for the passage of guideline 22. A tab 58 is also provided having edge portions 60 and 62 which diverge from one another. Thus, line 48 which loops tab 58 cinches when line 46 is employed.

Figure 5:
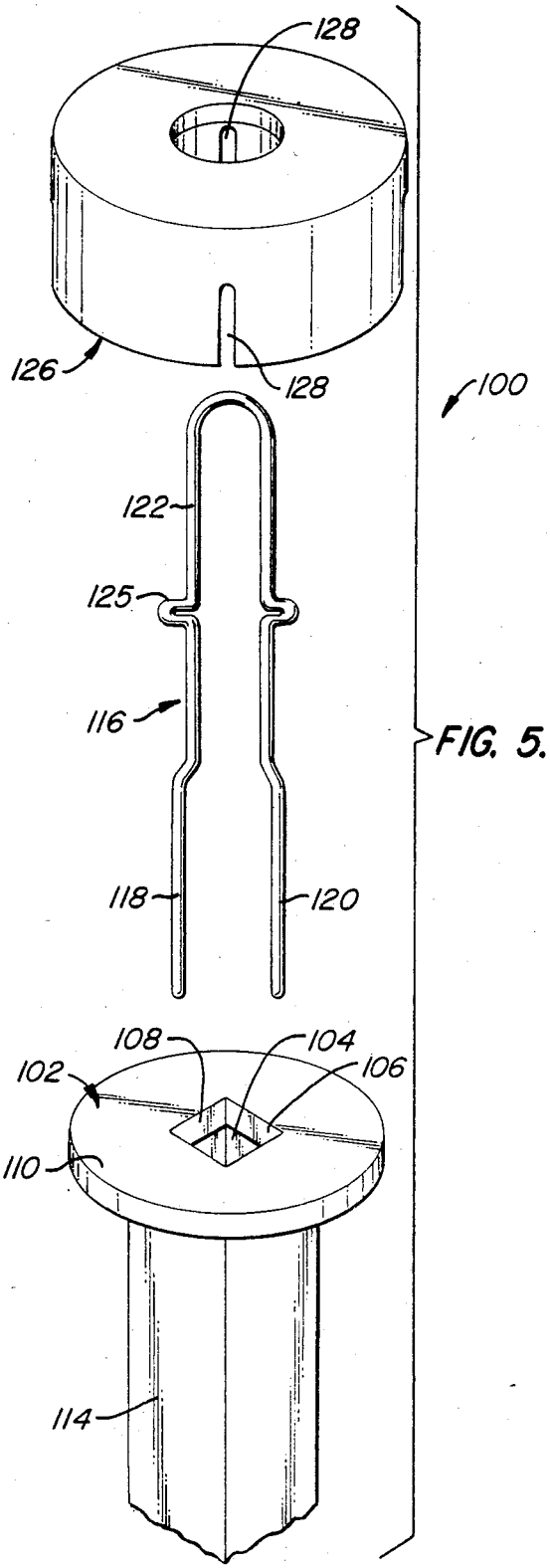
FIG. 5 is a top exploded perspective view of the rod slip mechanism of the present invention.

Turning to FIG. 5, the invention may be deemed to include mechanism 100 which is employed to prevent an object such as element 102 from being twisted in excess of a desired torque. Mechanism 100 includes a plate 102 having an opening 104 therethrough. Opening 104 has an edge portion 106 having at least one protuberance such as side 108. As shown, the configuration of opening 104 may be angular having a rectangular or square configuration. Plate 102 includes a first side 110, 112, best shown in FIG. 6. A gripping element 114 may be connected to plate 102. Member 116 is provided having first and second legs 118 and 120 which are resilient or springy. Member 116 is adapted to snuggly fit within opening 104 such that contact with side 108 of edge 106 of opening 104 causes legs 118 and 120 to move toward one another. Member 116 will turn with the turning of plate 102 unless the upper portion 122 of member 116 is stopped from turning.

Figure 6:
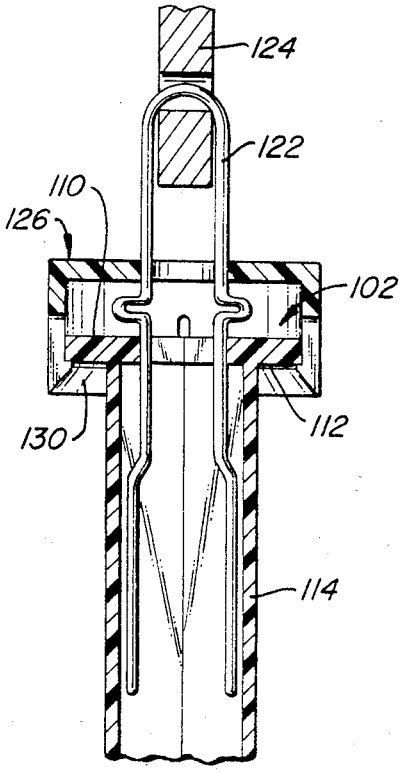
FIG. 6 is a sectional view of the rod slip mechanism of the present invention.

Turning to FIG. 6 it may be seen that an object 124 connects to upper portion 122 of member 116. Object 124 may be directly linked to worm gear tilting assembly shown in U.S. Pat. No. 3,918,513, heretofore referenced.

Member 116 also includes a pair of flanges 125 which are not intended to pass through opening 102. A cap 126 sits around plate 102 and effectively captures member 116 between the first side 110 of plate 102 and cap 126. Cap 126 is expandable and has a pair of slots 128 for this purpose. Collar 130 of cap 126 rests beneath second side 112 of plate 102. Member 116 may be formed of any spring metal while remaining portions of mechanism 100 may be formed of plastic, wood, metal or other material.

In operation the user of the venetian blind shown in FIGS. 1–4 merely moves line 46 up or down to tilt second slat 32 as desired. First slat 12 may be moved in a conventional manner by moving lines 24 and 26 in opposite directions. Slat 12 may be completely opaque while slat 32 may be translucent or serve as a color filter. In addition, the surfaces of first and second slats 12 and 32 may include different coloration or textural characteristics giving the user the choice of the same in different architectural situations.

In operation, the mechanism shown in FIGS. 5 and 6 would be attached to object 124 at upper portion 122 of member 116. Turning cap 102 and attached element 114 would also turn object 124. When object 124 can no longer turn member 116 will slip within opening 104 and plate 102 to prevent damage to element 124 or other mechanisms, such as a worm gear mechanism, attached thereto.

While in the foregoing embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A venetian blind comprising:

a. a first elongated slat, said first slat including a top, bottom, and an edge portion therebetween, said first slat further including first and second end portions extending along said elongation of said first slat;

b. first and second lines, said first line being linked to said first end portion of said first slat, said second line being linked to said second end portion of said first slat, said first and second lines supporting said first slat such that movement of said first and second lines in opposite directions tilts said first slat;

c. a second elongated slat said second slat including a top, bottom and an edge portion therebetween, said second slat further including first and second portions extending along said elongation of said second slat;

d. a third line, said third line being linked to said first end portion of said second slat, said second slat resting on said top of said first slat such that lifting of said first end portion of said second slat moves said second end portion of said second slat along said top of said first slat.

2. The venetian blind of claim 1 which, further comprises a first bridging line between said first line and said second line along said bottom of said first slat.

3. The venetian blind of claim 2 which further comprises a second bridging line between said first line and said second line along said top of said first slat.

4. The venetian blind of claim 3 in which said second slat includes a slot therethrough, said slot including a tab extending from the periphery of said slot, said tab further including first and second edges opposite each other and spaced from one another, said first and second edges being positioned in diverging relationship with one another.

5. The venetian blind of claim 4 which further includes a fourth line connected to said third line and engaging said tab in said slot of said second slat, said fourth line serving to link said third line to said second slat.

6. A device for controlling a twisting force of an object comprising:

a. a plate having a first and second side and having an opening therethrough, said opening having an edge portion with at least one protuberance;

b. a member having first and second legs resiliently positioned in relation to one another, said first and second legs being adapted to frictionally fit within said opening through said plate and rotatable within said opening in said plate upon the application of sufficient force on said member, said protuberance forcing said first and second legs toward one another during rotation of said member along said edge portion of said opening said member extending from at least said first side of said plate;

c. means for connecting the object to said extention of said member from said first side of said plate.

7. The device of claim 6 in which said opening through said plate is angular.

8. The device of claim 6 in which said member extending from said first side of said plate includes a flange extending beyond the periphery of said opening through said plate and further comprises a cap substantially covering said first side of said plate.

9. The device of claim 8 in which further comprises an element connected to said plate and extending from said second side of said plate said element including an outer gripping surface.

10. The device of claim 9 in which said cap includes an opening therethrough and said member extends through said cap opening.

11. The device of claim 10 in which said cap is expandable.

* * * * *